US010322858B2

(12) United States Patent
Hsieh

(10) Patent No.: US 10,322,858 B2
(45) Date of Patent: Jun. 18, 2019

(54) CONTAINER THAT PREVENTS FROM AN ILLEGAL OPERATION AND CAN BE EASILY IDENTIFIED AFTER BEING ILLEGALLY OPERATED

(71) Applicant: VIGOURPLASTIC CO., LTD., Lukang Township, Changhua County (TW)

(72) Inventor: Albert Hsieh, Lukang Township, Changhua County (TW)

(73) Assignee: VIGOURPLASTIC CO., LTD., Lukang Township (TW)

( * ) Notice: Subject to any disclaimer, the term of this patent is extended or adjusted under 35 U.S.C. 154(b) by 6 days.

(21) Appl. No.: 15/877,057

(22) Filed: Jan. 22, 2018

(65) Prior Publication Data

US 2018/0141731 A1 May 24, 2018

Related U.S. Application Data

(63) Continuation-in-part of application No. 15/148,566, filed on May 6, 2016, now Pat. No. 9,950,845.

(30) Foreign Application Priority Data

Oct. 15, 2015 (TW) ..... 104133819

(51) Int. Cl.

| | |
|---|---|
| ***B65D 43/16*** | (2006.01) |
| ***B65D 43/26*** | (2006.01) |
| ***B65D 55/02*** | (2006.01) |

(52) U.S. Cl.
CPC ..... *B65D 55/024* (2013.01); *B65D 43/162* (2013.01); *B65D 43/26* (2013.01);
(Continued)

(58) Field of Classification Search
CPC .... B65D 55/024; B65D 43/26; B65D 43/162; B65D 2101/0023; B65D 2543/00296;
(Continued)

(56) References Cited

U.S. PATENT DOCUMENTS

2012/0241456 A1* 9/2012 Vovan ..... B65D 43/0254 220/270
2014/0138383 A1* 5/2014 Lisowy ..... B65D 43/162 220/270

(Continued)

*Primary Examiner* — James N Smalley
(74) *Attorney, Agent, or Firm* — Egbert Law Offices, PLLC

(57) ABSTRACT

A container includes a casing defining an opening and formed with a first abutting edge surrounding the opening. A cover is selectively mounted onto the casing for closing the opening, wherein the cover has a second abutting edge laterally extending therefrom and abutting against the first abutting edge when the cover closes the opening. A puller extends from the second abutting edge of the cover. A snapping device is formed between the casing and the puller. The snapping device includes a plug formed on the puller and a socket defined in the casing for receiving the plug. Two weakened portions are formed on the puller such that the puller is irreversibly curved after being lifted due to the weakened portion and the curved puller is used as a basis for easily identifying whether the container is illegally operated or not.

1 Claim, 10 Drawing Sheets

(52) U.S. Cl.
CPC .. *B65D 2101/0023* (2013.01); *B65D 2251/02* (2013.01); *B65D 2543/005* (2013.01); *B65D 2543/00194* (2013.01); *B65D 2543/00296* (2013.01); *B65D 2543/00333* (2013.01); *B65D 2543/00833* (2013.01)

(58) Field of Classification Search
CPC ..... B65D 2543/00333; B65D 2543/00194; B65D 2543/00833; B65D 2543/005
USPC ..... 220/270
See application file for complete search history.

(56) References Cited

U.S. PATENT DOCUMENTS

| | | | | |
|---|---|---|---|---|
| 2015/0028033 | A1* | 1/2015 | Samuel | B65D 43/0266 220/270 |
| 2018/0244438 | A1* | 8/2018 | Morichon | B65D 43/0218 |

* cited by examiner

CONTAINER THAT PREVENTS FROM AN ILLEGAL OPERATION AND CAN BE EASILY IDENTIFIED AFTER BEING ILLEGALLY OPERATED

CROSS-REFERENCE TO RELATED U.S. APPLICATIONS

The present application is a continuation-in-part of U.S. application Ser. No. 15/148,566, filed on May 6, 2016, and entitled "Container That Prevents from an Illegal Operation and Can Be Easily Identified after Being Illegally Operated", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a container, and more particularly to a container that prevents illegal operation and can be easily identified after being illegally operated.

2. Description of Related Art Including Information Disclosed Under 37 CFR 1.97 and 37 CFR 1.98

Vacuum-formed plastic containers are usually made to have a box-shaped or a cup-shaped containing structure and are used in the supermarkets for keeping food fresh. The plastic container is transparent for the buyer to clearly see the contents, such as jelly-like, fruit or liquid foods and provided to stimulate customer's buying intentions. For containing liquid foods, the conventional plastic containers focus on the function of a water-tight seal. The conventional plastic container usually includes a hollow body and a body for selectively closing the hollow body.

For preventing the container from an illegal operation before checkout, some businesses position the cover of the container by staples. However, the casing or the cover of the container may be broken due to the staples when the buyer forcibly opens the cover. As a result, the container cannot be reused.

In addition, some businesses provided a snapper for temporarily positioning the cover on the casing of the container and a puller extending from cover for upwardly lifting the cover. As a result, the snapper is maintained in a cavity when the puller is lifted for opening the cover and a pre-broken line, formed on the puller is broken. However, the conventional plastic container is transparent and the cover is flexible such that the cover may be reinstated. Consequently, the manager and the checkout staff is difficultly to identify whether the container is illegally operated or not. The altered plastic container cannot effectively prevent an illegal operation and cannot be easily identified after being illegally operated.

The present invention has arisen to mitigate and/or obviate the disadvantages of the conventional plastic container.

BRIEF SUMMARY OF THE INVENTION

The main objective of the present invention is to provide an improved container that prevents illegal operation and can be easily identified after being illegally operated.

To achieve the objective, the container in accordance with the present invention comprises a casing defining an opening and formed with a first abutting edge surrounding the opening. A cover is selectively mounted onto the casing for closing the opening, wherein the cover has a second abutting edge laterally extending therefrom and abutting against the first abutting edge when the cover closes the opening. A puller is connected to an outer side of the second abutting edge. A snapping device includes a plug formed on the puller and a socket defined in the cover for receiving the plug and holding the plug in place. A pre-broken line is formed on the puller and surrounds a root of the plug, wherein the plug is maintained in the socket when the puller is upwardly pulled and the pre-broken line is broken, and the puller abuts a plan area surrounding the socket. Two weakened portions are formed on the puller, wherein each weakened portion has a plan structure and is flexible, the two weakened portions diametrically correspond to each other relative to the pre-broken line and respectively vertical to an operating line of the puller such that the puller is irreversibly curved after being lifted due to the weakened portion.

Further benefits and advantages of the present invention will become apparent after a careful reading of the detailed description with appropriate reference to the accompanying drawings.

DETAILED DESCRIPTION OF THE INVENTION

Figure 1:
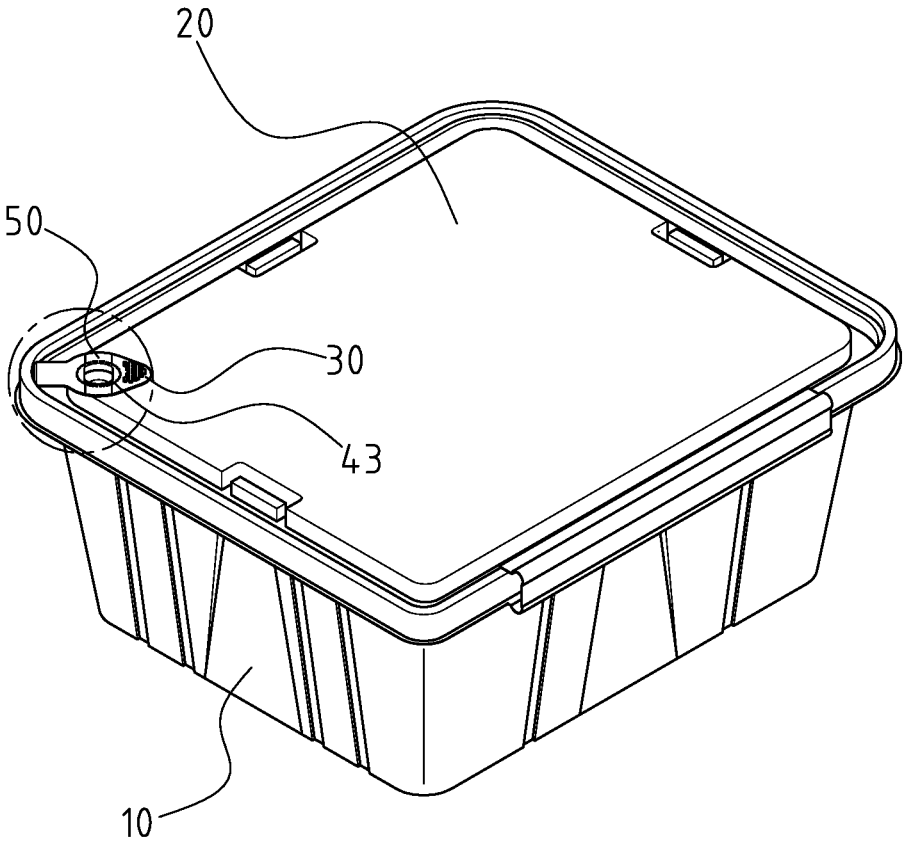
FIG. 1 is a closed perspective view of a container that prevents illegal operation and can be easily identified after being illegally operated in accordance with the present invention.
Figure 2:
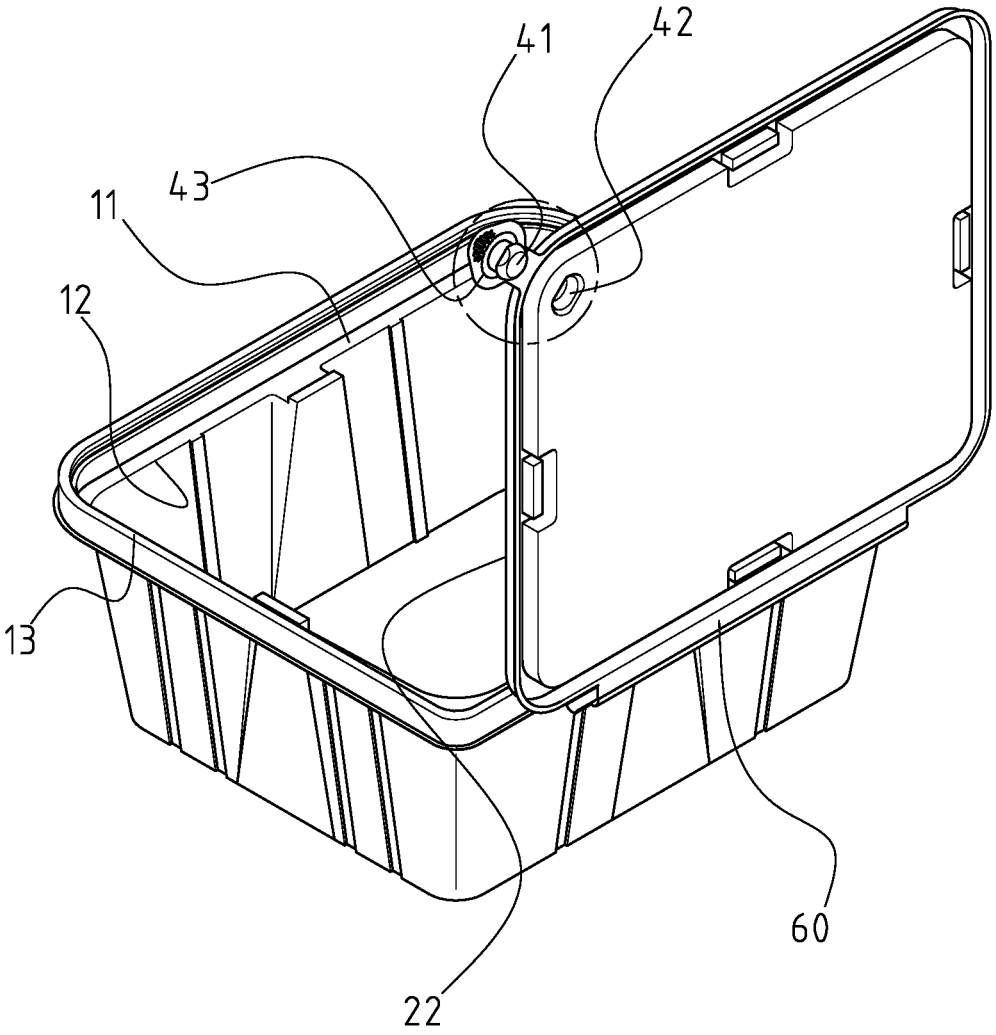
FIG. 2 is an opened perspective view of the container in accordance with the present invention.
Figure 3:
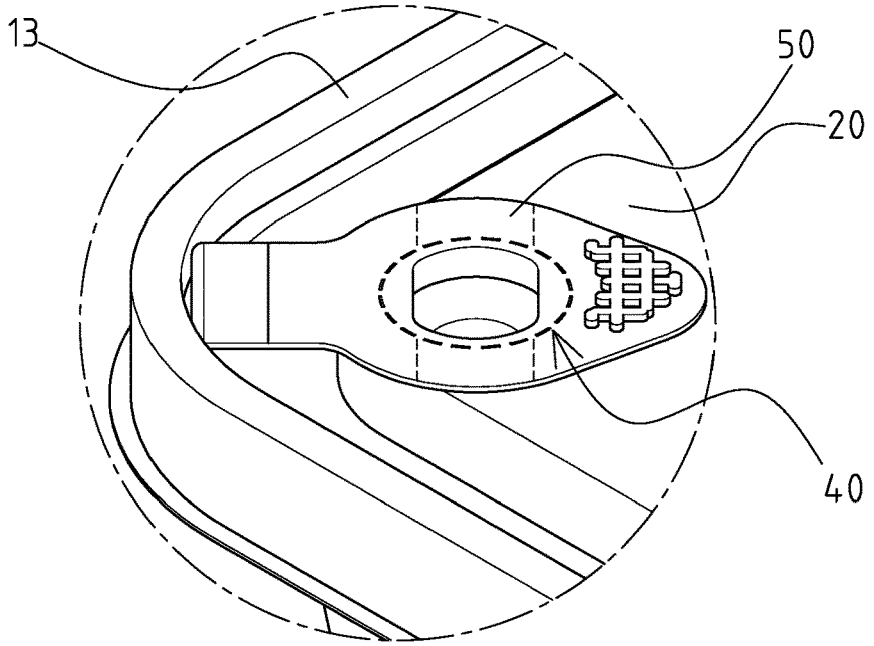
FIG. 3 is a partially enlarged view of the container in FIG. 1.
Figure 4:
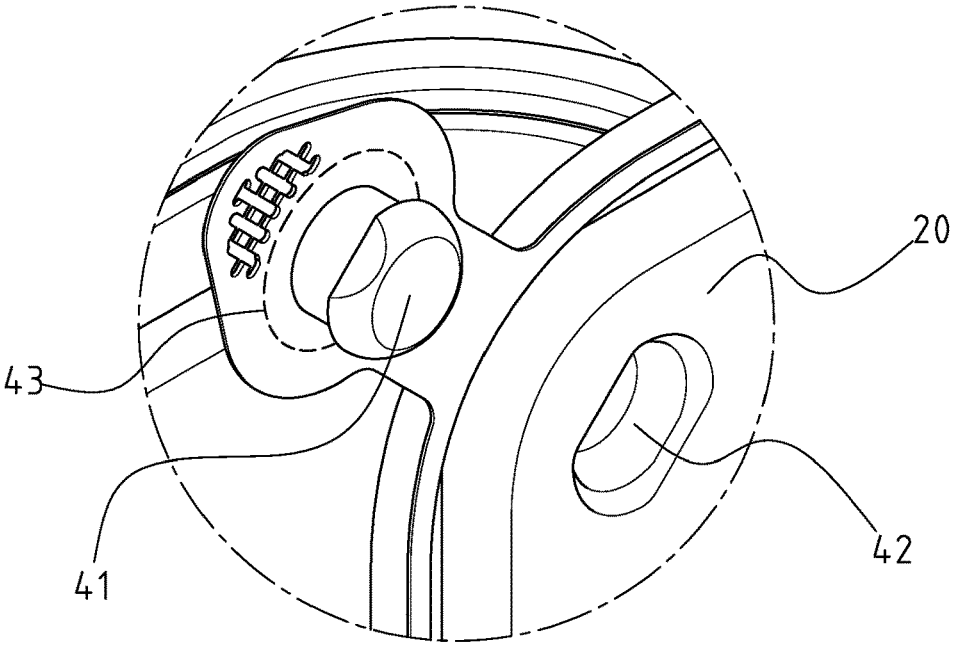
FIG. 4 is a partially enlarged view of the container in FIG. 2.
Figure 5:
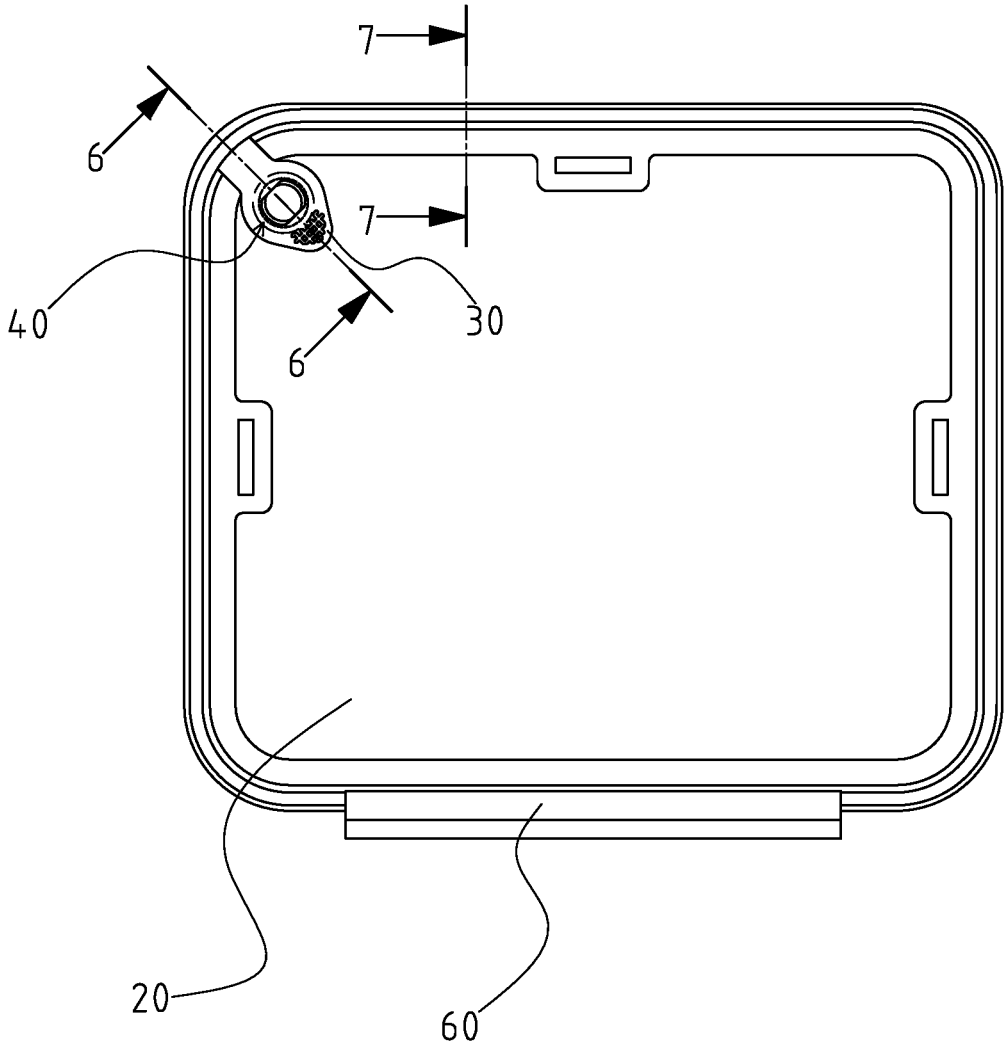
FIG. 5 is a top plan view of the container in accordance with the present invention.
Figure 5A:
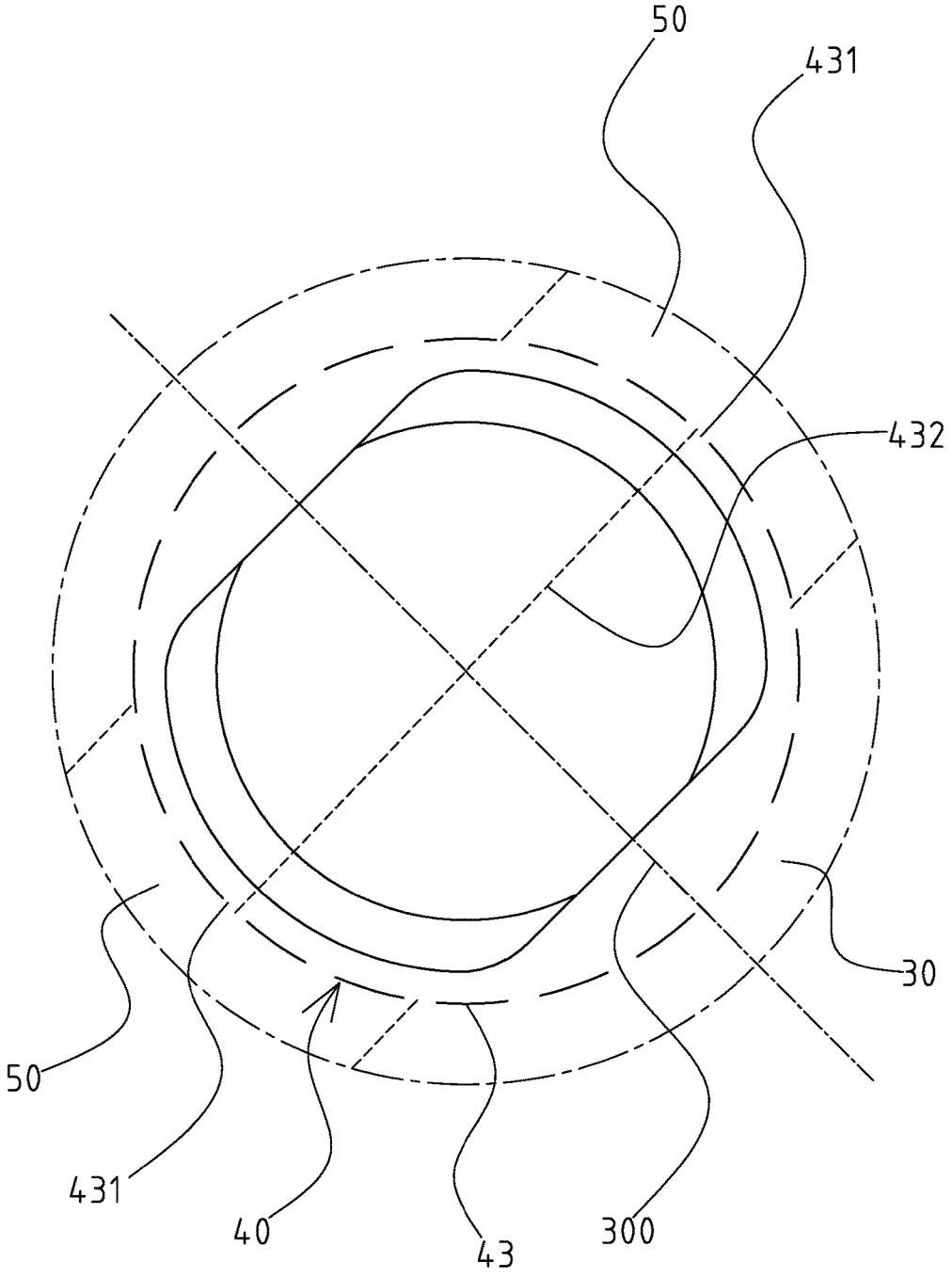
FIG. 5A is a partially enlarged view of the container in FIG. 5.
Figure 6:
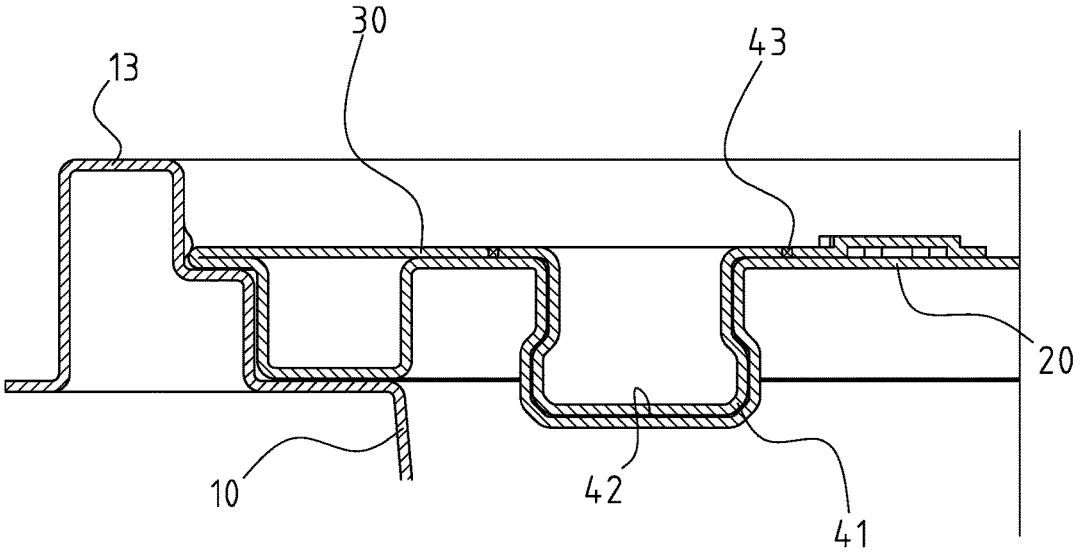
FIG. 6 is a cross-sectional view of the container in accordance with the present invention along line 6-6 in FIG. 5.
Figure 8:
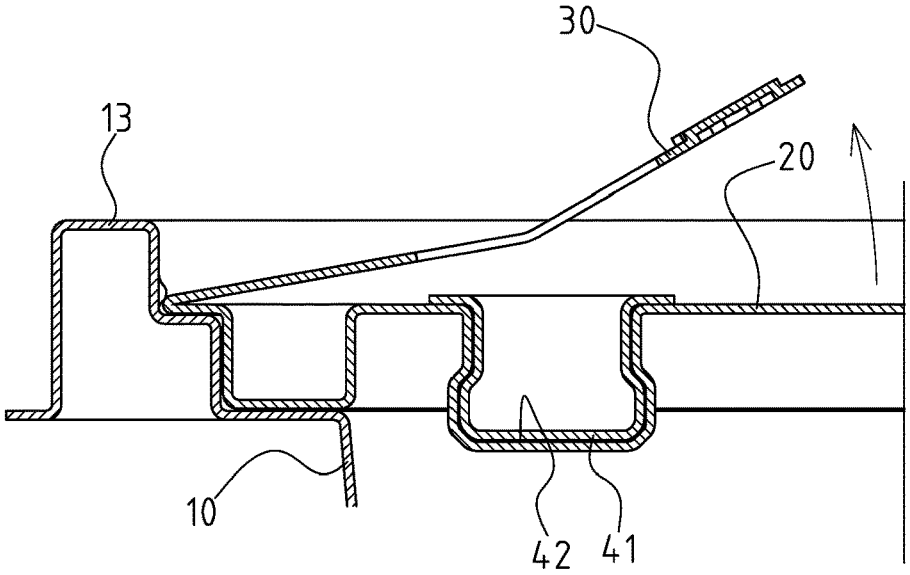
FIG. 8 operational view of the puller of the container in accordance with the present invention.
Figure 9:
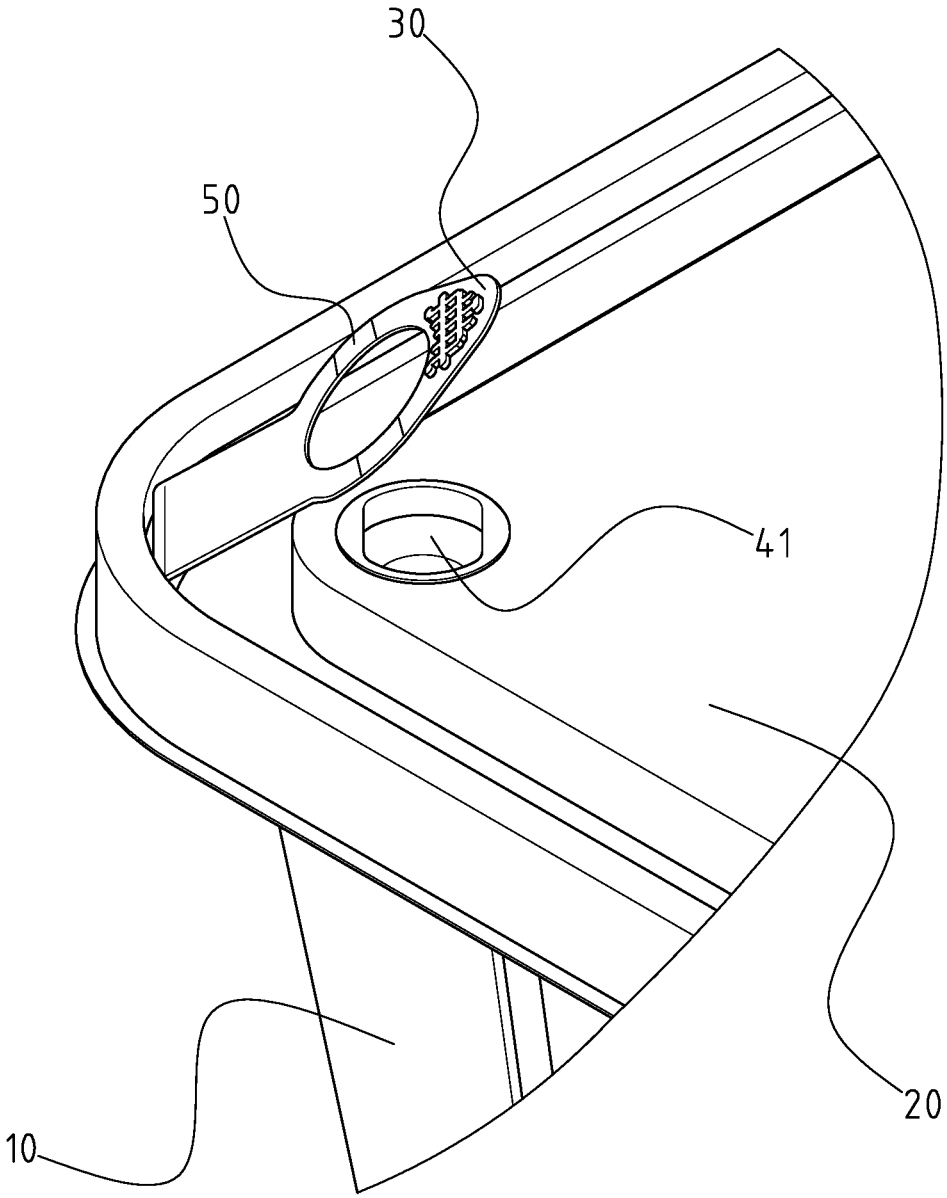
FIG. 9 is a partially perspective view of the container in accordance with the present invention when the pre-broken line is broken.

Referring to the drawings and initially to FIGS. 1-7, a container, that prevents illegal operation and can be easily identified after being illegally operated, in accordance with the present invention comprises a casing 10 defining an opening 12 and formed with a first abutting edge 11 surrounding the opening 12. A cover 20 is selectively mounted onto the casing 10 for closing the opening 12, wherein the cover 20 has a second abutting edge 22 laterally extending therefrom and abutting against the first abutting edge 11 when the cover 20 closes the opening 12. A puller 30 is connected to an outer side of the second abutting edge 22. In the preferred embodiment of the present invention, the puller 30 is situated on a corner of the cover 20. A snapping device 40 includes a plug 41 formed on the puller 30, a socket 42 defined in the cover 20 for receiving the plug and holding the plug 41 in place. A pre-broken line 43 is formed on the puller 30 and surrounds a root of the plug 41, wherein the plug 41 is maintained in the socket 42 when the puller 30 is upwardly pulled and the pre-broken line 43 is broken. As shown in FIG. 6, the puller 30 abuts a plan area (not numbered) surrounding the socket 42. Two weakened portions 50 are formed on the puller 30, wherein each weakened portion 50 has a plan structure and is flexible. With reference to FIGS. 3, 5 and 5A, the two weakened portions 50 diametrically correspond to each other relative to the pre-broken line 43 and respectively are vertical to an operating line 300 of the puller 30 such that the puller 30 is irreversibly curved after being lifted due to the weakened portion 50 and the curved puller 30 is used as a basis for easily identifying whether the container is illegally operated, as shown in FIGS. 8 and 9. In addition, the puller 30 easily becomes curved because the puller 30 abuts the plan area surrounding the socket 42 and the plan area provides a stable support to the puller during being pulled.

With reference to FIGS. 1 and 3, the pre-broken line 43 is separated from a periphery of the plug 41 and the two weakened portions are respectively formed between the pre-broken line 43 and the opposite sides of the puller 30.

With reference to FIGS. 8 and 9, the pre-broken line 43, surrounding the plug 41, is broken, the puller 30 forms a pull-tab and the puller 30 is curved along the two weakened portions 50 when the puller 30 is lifted.

With reference to FIG. 5A, the pre-broken line 43 is divided into a first portion and a second portion by the operating line 300, wherein the first portion and the second portion respectively includes multiple connecting sections 431. Each connecting section 431 of the first portion of the pre-broken line 43 aligns with a corresponding one of the multiple connecting sections 431 of the second portion of the pre-broken line 43. A connecting line 432 of the corresponding connecting sections 431 is vertical to the operating line 300 to make the puller 30 being easily curved when the puller 30 is lifted.

Figure 10:
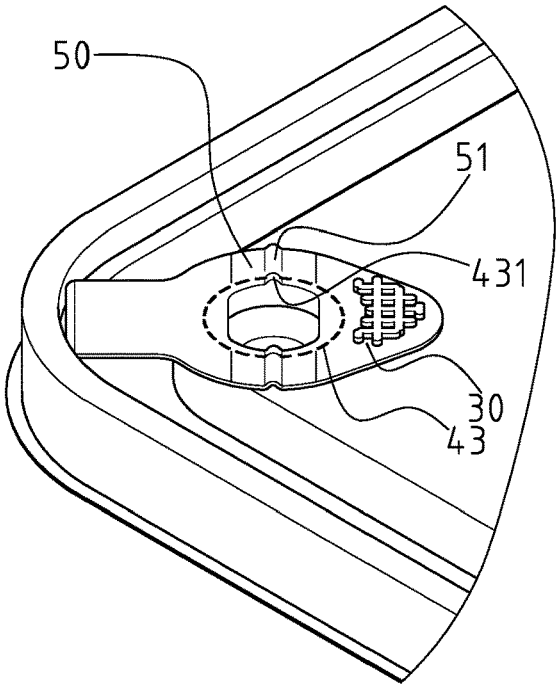
FIG. 10 is a partially perspective view of a second embodiment of the container in accordance with the present invention.
Figure 11:
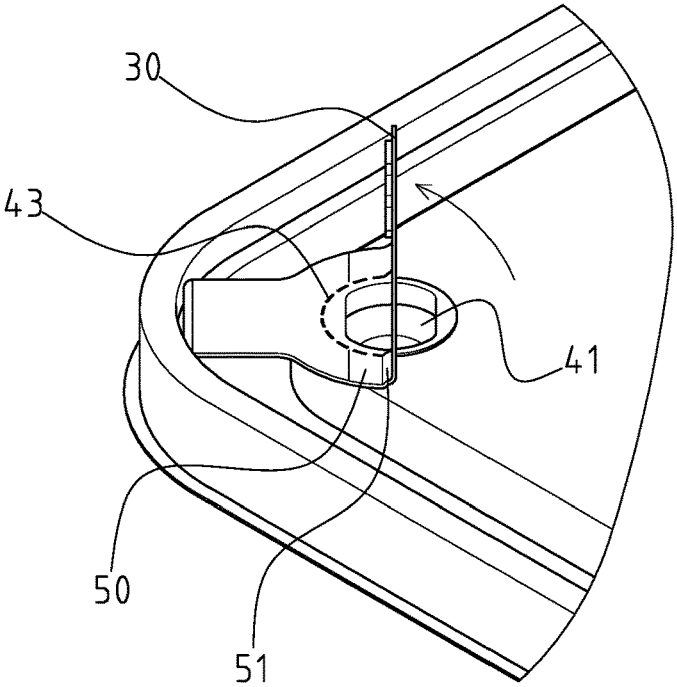
FIG. 11 is an operational view of the container in accordance with the present invention in FIG. 10.

With reference to FIGS. 10 and 11, each weakened portion 50 is formed with a fold edge 51, wherein each fold edge 51 aligns with a corresponding one of the multiple connecting sections 431 of the pre-broken line 43. In the preferred embodiment of the present invention, the fold edges 51 provide a greater resistance during lifting the puller 230 such that the operator more hardly forces the puller 30 and the puller 30 is more clearly curved.

With reference to FIG. 2, at least one connecting plate 60 is provided to connect two corresponding sides of the cover 20 and the casing 10 such that the cover 20 is upward and inclined relative to the casing 10 after being lifted from the opening 12 of the casing 10. However, the at least one connecting plate 60 is not absolutely necessary to the container in accordance with the present invention.

Figure 7:
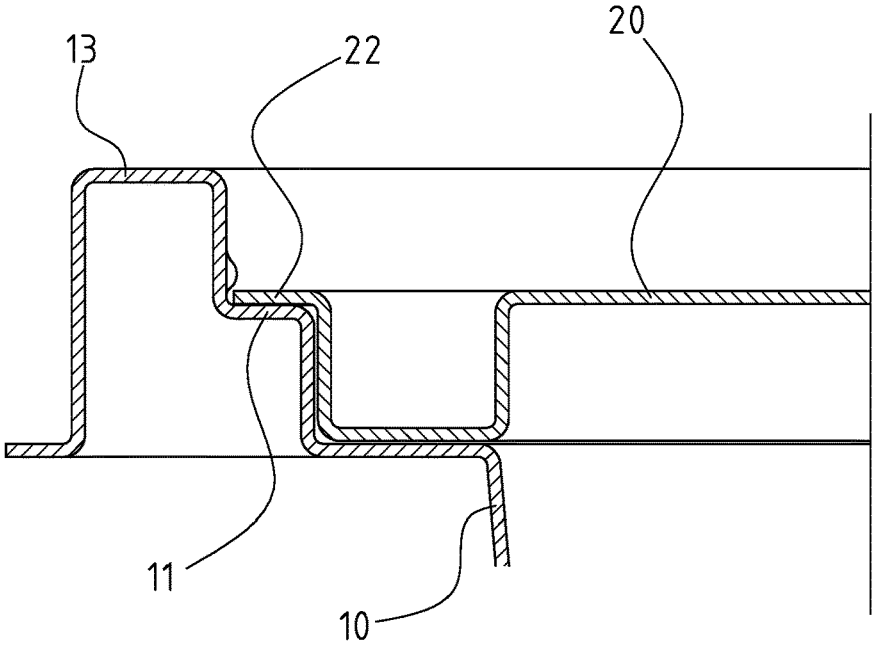
FIG. 7 is a cross-sectional view of the container in accordance with the present invention along line 7-7 in FIG. 5.

With reference to FIG. 7, the first abutting edge 11 is formed with a first wall 13, wherein an outer periphery of the second abutting edge 22 of the cover 20 is laterally engaged to the first wall 13. A groove 14 is laterally defined in a root of the first wall 13 and the outer periphery of the second abutting edge 22 of the cover 20 is laterally engaged into the groove 14. In the preferred embodiment of the present invention, the first wall is provided to prevent an outer periphery of the first abutting edge 11 from an illegal dig relative to a fingernail.

Figure 12:
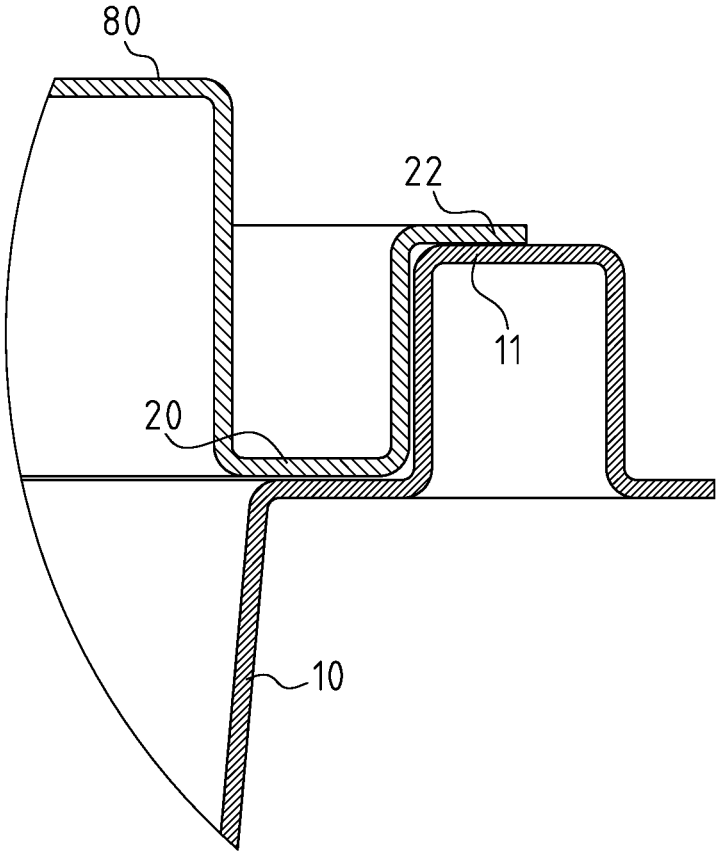
FIG. 12 is a partially cross-sectional view of a second embodiment of the cover of the container in accordance with the present invention.

With reference to FIG. 12, a second wall 80 is formed on the cover 20 along the second abutting edge 22 for preventing the abutted first abutting edge 11 and the second abutting edge 22 from being detached from each other by pinching with one's fingers because the fingers touch the second wall 80 during pinching.

As described above, the manager and the checkout staff can easily identify whether the container is illegally operated or not due to the curved puller 30 that is deformed when being pulled relative to the weakened portion 50. Consequently, the effect of preventing the container in accordance with the present invention from an illegally operation is promoted.

Although the invention has been explained in relation to its preferred embodiment, it is to be understood that many other possible modifications and variations can be made without departing from the spirit and scope of the invention as hereinafter claimed.

I claim:

1. A container that prevents authorized access and which indicates a tampering, the container comprising:

a casing defining a opening having a first abutting edge surrounding the opening;

a cover mounted on said casing so as to selectively close the opening, wherein said cover has a second abutting edge extending therefrom and abutting against the first abutting edge when said cover closes the opening;

a puller connected to an outer side of said second abutting edge;

a snapping device having a plug formed on said puller and a socket defined in said cover, the socket receiving the plug and holding the plug in place, wherein a pre-broken line is formed on said puller and surrounds a root of the plug, and wherein the plug is retained in the socket when said puller is pulled upwardly and the pre-broken line is broken, the puller abuts a plan area surrounding the socket; and a pair of weakened portions formed on said puller, wherein each of said pair of weakened portions has a long and narrow planar structure and is flexible, the pair of weakened portions diametrically corresponding to each other relative to the pre-broken line, wherein said pair of weakened portions are connected to the plug by the pre-broken line and become curly when lifted so as to provide proof that the plug has been tampered with after the pre-broken line surround by the plug is broken, wherein each of said pair of weakened portions is formed with a fold edge, the fold edge aligned with a corresponding one of multiple connecting sections of the pre-broken line.

* * * * *